US011473793B2

(12) United States Patent
Park

(10) Patent No.: US 11,473,793 B2
(45) Date of Patent: Oct. 18, 2022

(54) NON-POWERED VENT

(71) Applicant: Tai Up Park, Gwangmyeong-si (KR)

(72) Inventor: Tai Up Park, Gwangmyeong-si (KR)

( * ) Notice: Subject to any disclaimer, the term of this patent is extended or adjusted under 35 U.S.C. 154(b) by 172 days.

(21) Appl. No.: 16/965,380

(22) PCT Filed: Dec. 11, 2018

(86) PCT No.: PCT/KR2018/015696
§ 371 (c)(1),
(2) Date: Jul. 28, 2020

(87) PCT Pub. No.: WO2019/208899
PCT Pub. Date: Oct. 31, 2019

(65) Prior Publication Data

US 2021/0156578 A1 May 27, 2021

(30) Foreign Application Priority Data

Apr. 27, 2018 (KR) ..... 10-2018-0049347

(51) Int. Cl.
*F24F 7/02* (2006.01)
*F24F 7/00* (2021.01)

(52) U.S. Cl.
CPC ..... *F24F 7/02* (2013.01); *F24F 2007/004* (2013.01)

(58) Field of Classification Search
CPC .. F24F 11/0001; F24F 7/02; F24F 7/04; F24F 2007/001; F24F 2007/004; F24F 13/02; F24F 13/20
USPC ..... 454/35, 36, 275, 353, 356, 367
See application file for complete search history.

(56) References Cited

U.S. PATENT DOCUMENTS 2,985,091 A * 5/1961 Hatcher ..... E04D 13/1471 454/366
3,469,518 A * 9/1969 Ben ..... F24F 7/02 454/366
3,853,042 A * 12/1974 Tobiasson ..... F24F 7/02 454/3

(Continued)

FOREIGN PATENT DOCUMENTS

KR 10-2004-0102938 12/2004
KR 20-0466362 4/2013

(Continued)

*Primary Examiner* — Avinash A Savani
*Assistant Examiner* — Dana K Tighe
(74) *Attorney, Agent, or Firm* — Lex IP Meister, PLLC

(57) ABSTRACT

A non-powered ventilator that prevents backdraft by forming a vortex forming area by internal and external airflows so as to smoothly exhaust indoor airflow to outside is proposed. The non-powered ventilator includes: a fixing member provided with a fixing flange part; a finishing cap part provided with a finishing cone part, an opening part, and a finishing flange part forming fastening holes; a discharging cap part respectively provided with a discharging cone part, a bent edge part, a discharging flange part, and fastening holes; a backdraft prevention member provided with a hemispherical curved plate body, at least three support legs, and opening parts, and a first bent part as well as a circular groove; and fastening members fastened and assembled by bolts and nuts through the fastening holes of the discharging cap part, the backdraft prevention member, and the fixing member.

3 Claims, 9 Drawing Sheets

(56) References Cited

U.S. PATENT DOCUMENTS

| | | | | |
|---|---|---|---|---|
| 6,190,251 | B1 * | 2/2001 | Park | F23L 17/08 454/35 |
| 8,303,385 | B2 * | 11/2012 | Park | F24F 7/025 454/339 |
| 2017/0108234 | A1 * | 4/2017 | Lee | F24F 7/02 |

FOREIGN PATENT DOCUMENTS

| | | |
|---|---|---|
| KR | 10-1447658 | 10/2014 |
| KR | 20-0482772 | 3/2017 |
| KR | 10-2017-0065768 | 6/2017 |
| KR | 10-1785903 | 10/2017 |
| KR | 102159714 | 9/2020 |

* cited by examiner

[FIG. 1]
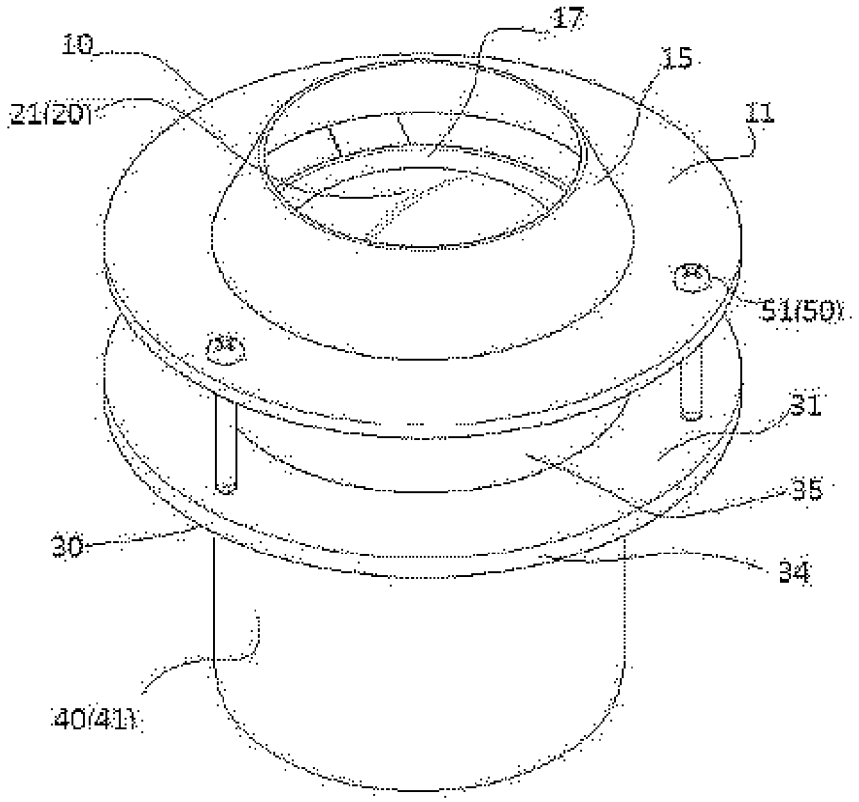

[FIG. 2]
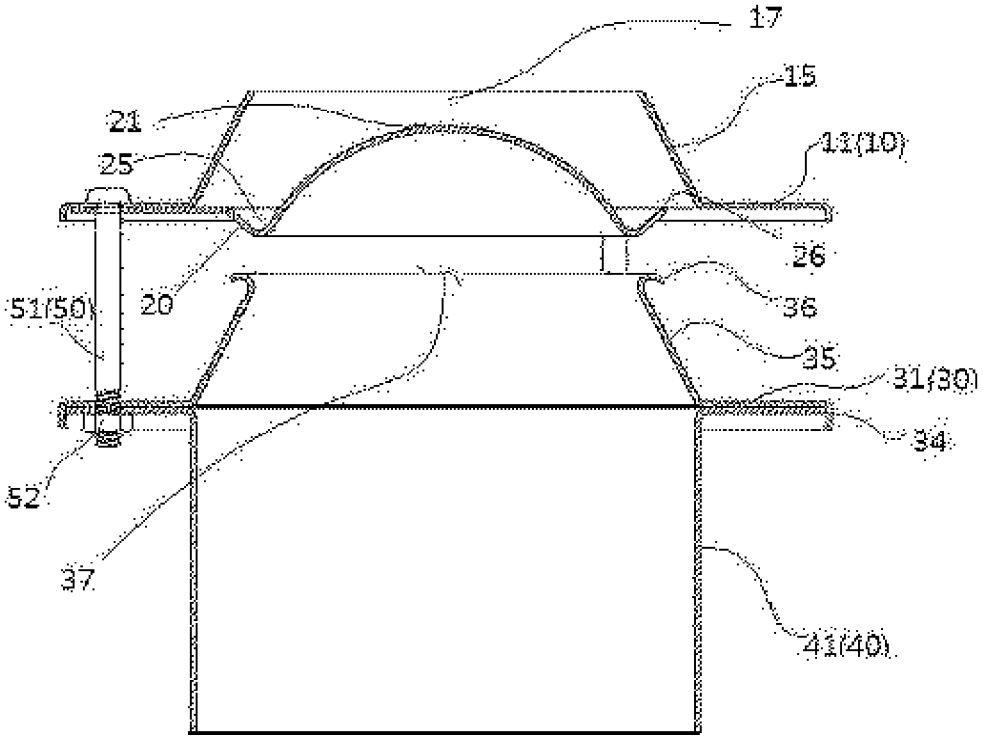

[FIG. 3a]
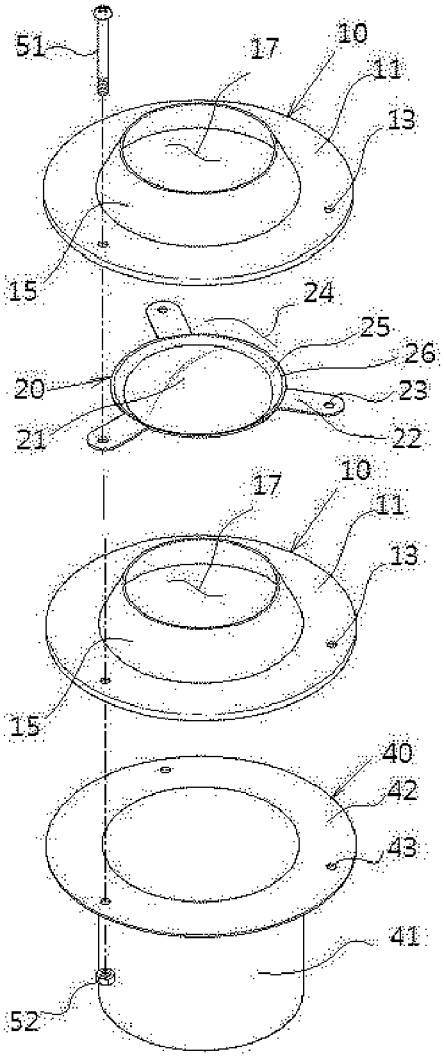

[FIG. 3b]
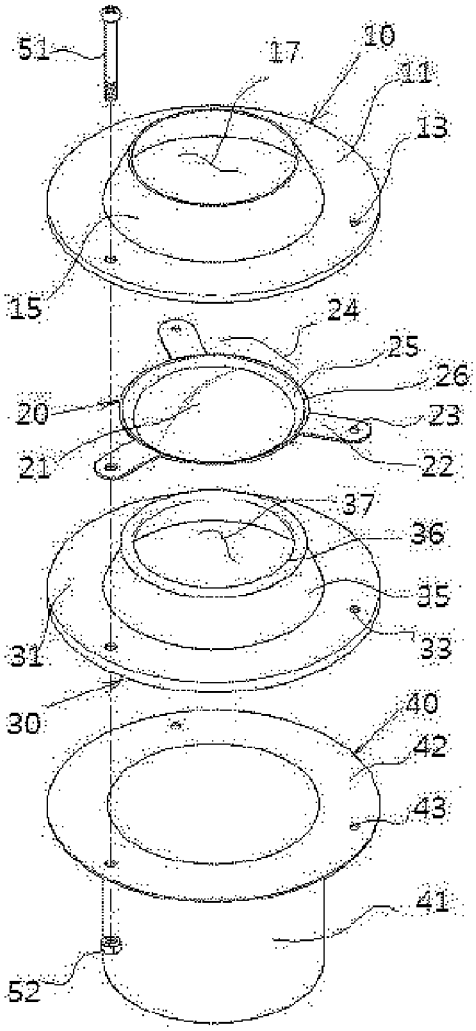

[FIG. 4a]
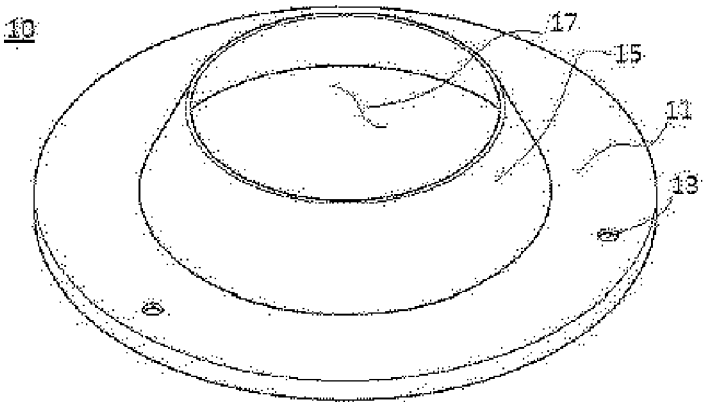
[FIG. 4b]
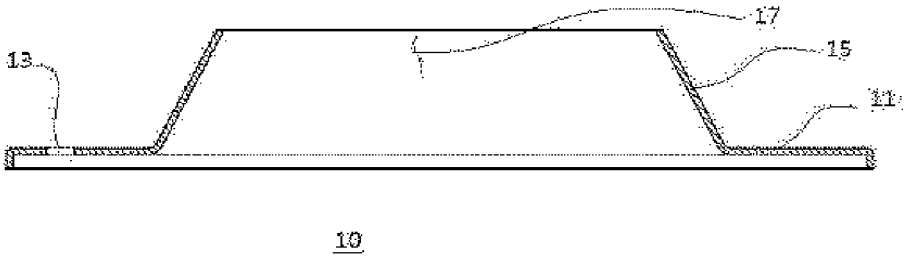

[FIG. 5a]
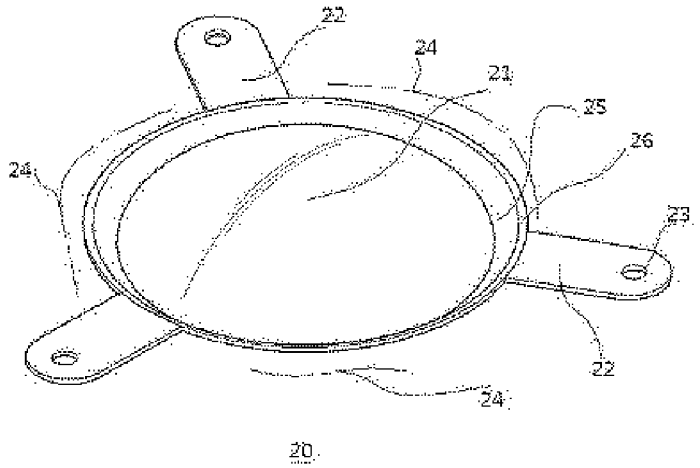
[FIG. 5b]
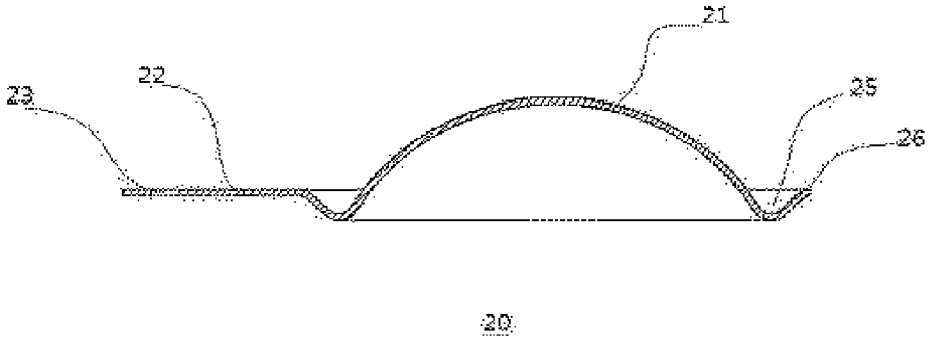

[FIG. 6a]
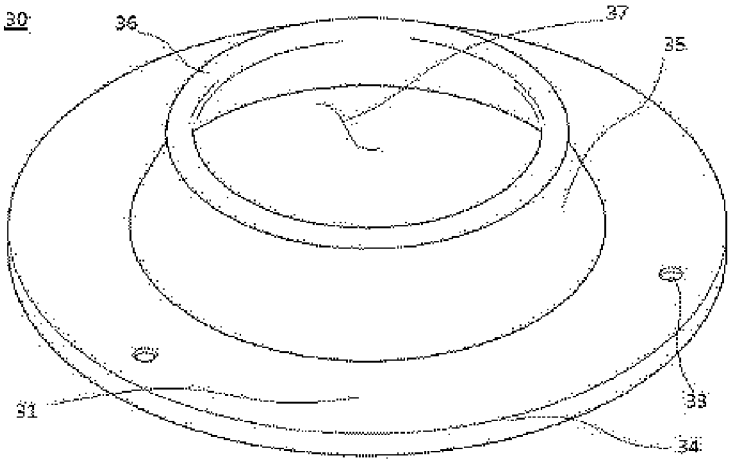
[FIG. 6b]
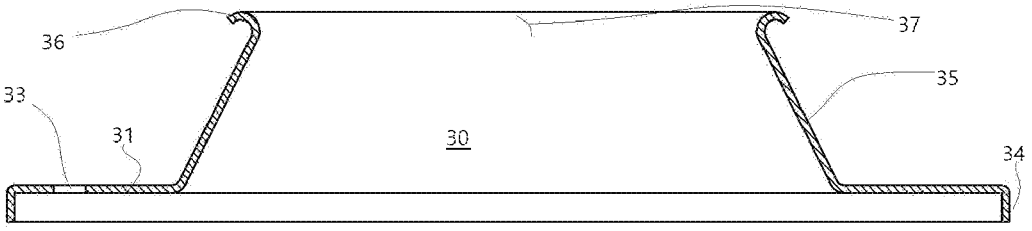

[FIG. 7]
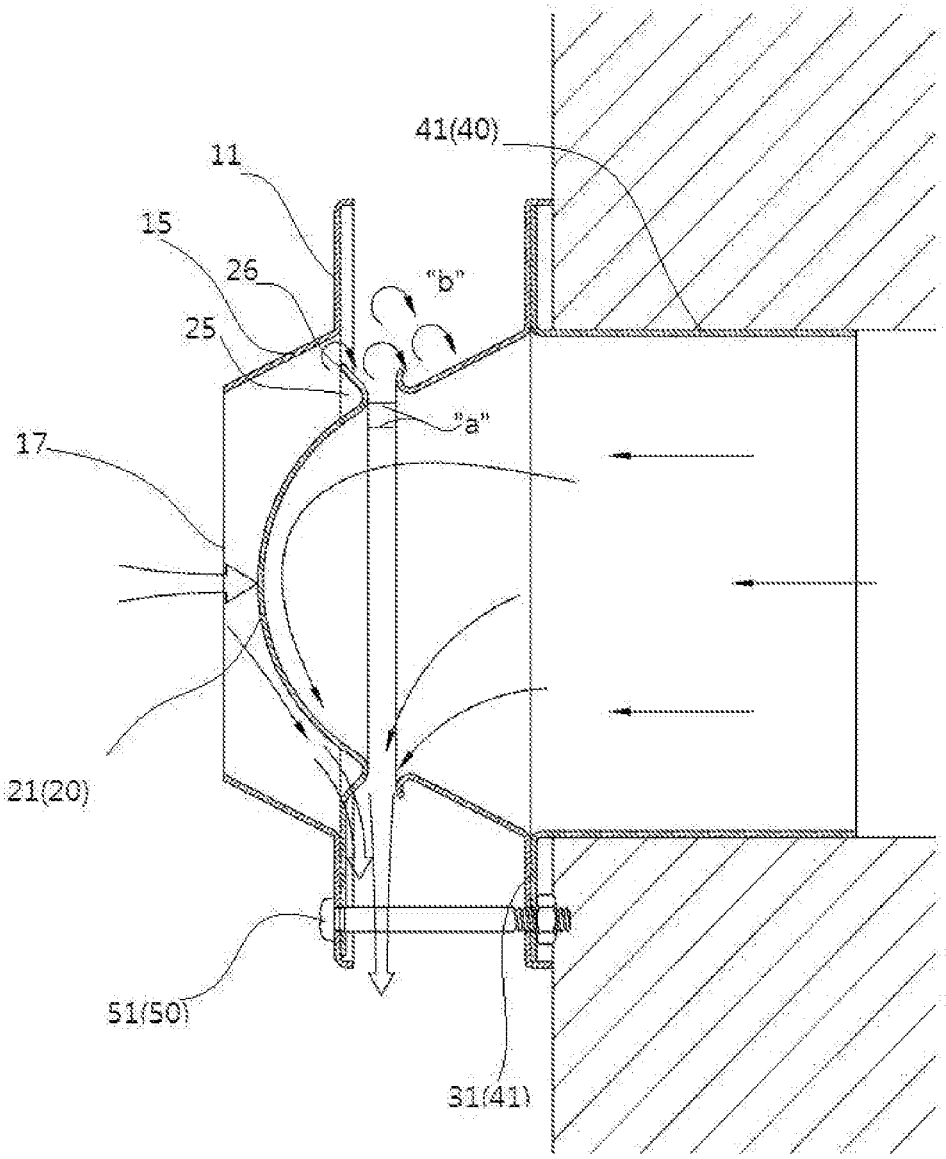

[FIG. 8]
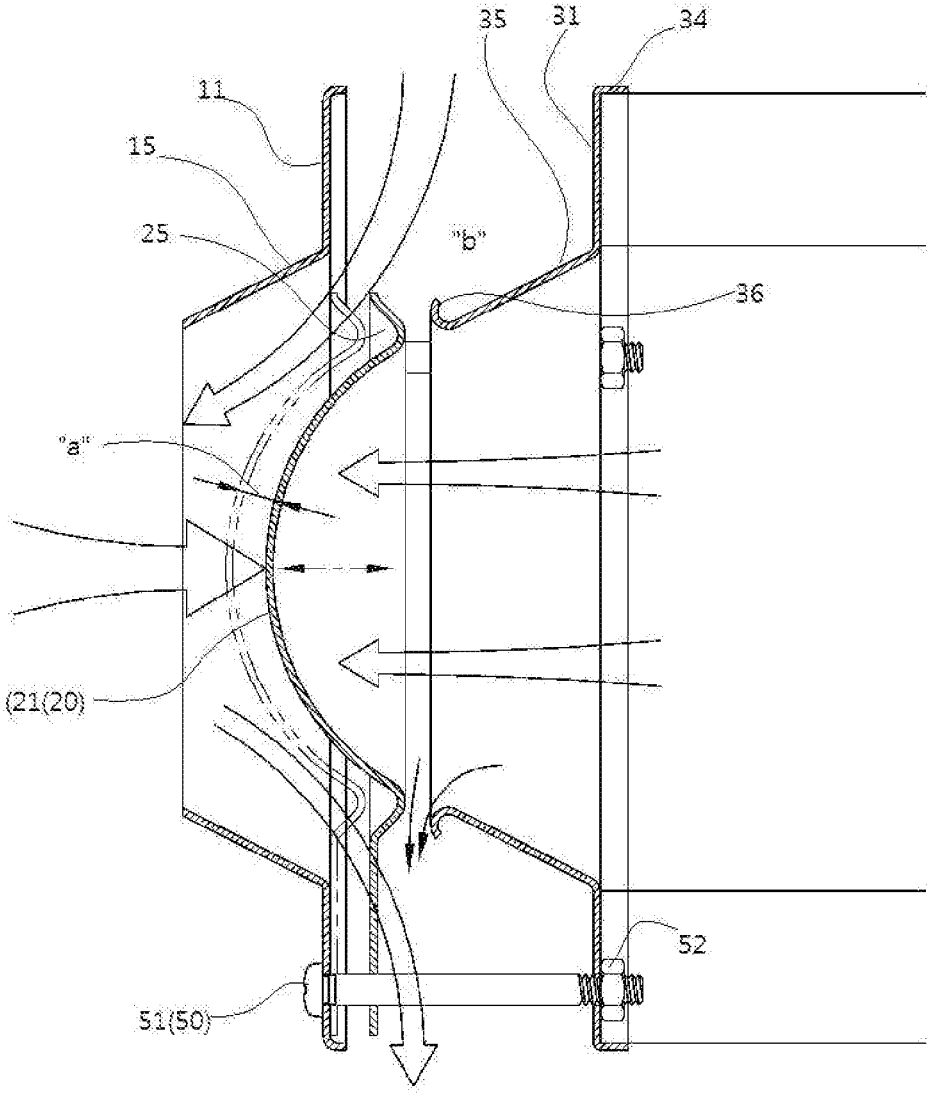

NON-POWERED VENT

TECHNICAL FIELD

The present invention relates to a non-powered ventilator used when exhausting indoor air, and more particularly, to a non-powered ventilator in which a part of outside airflow forms vortices near an opening of the installed ventilator, so that backdraft is prevented so as not to allow external air from entering in the indoor direction of the ventilator, whereby the indoor airflow is smoothly exhausted to the outside.

BACKGROUND ART

In general, a non-powered ventilator is installed in an exhaust duct of a building so that indoor airflow exhausted through the exhaust duct is discharged to the outside of the building by the air pressure of the outside airflow without having assistance of power, and the ventilator does not use a power source used for a blower fan, for instance.

In general, such a ventilator is installed horizontally, but when describing the ventilator based on a vertical structure due to the structure of the ventilator, a wing (also referred to as a discharging cone part, or a finishing cone part) is provided, which is inclined downward from the center thereof to a ring-shaped part thereof (i.e., a peripheral part), and a cap is provided as an upper layer of the wing (also referred to as a discharging cap part and a finishing cap part), thereby preventing rainwater or moisture from entering the exhaust duct. Then, polluted indoor air (also referred to as indoor airflow) is drawn upward by a side-pass airflow according to Bernoulli's principle, so that the polluted indoor air is quickly exhausted through the exhaust duct, and thus the polluted indoor air, discharged gas, and the like may be discharged to the atmosphere.

In such a ventilator, a multi-layer ventilation structure is used stacking two or more of the caps (i.e., an upper part airflow guide plate, the finishing cap part, and the discharging cap part) that blocks a central passage in a form of the ring-shaped wing and the ring-shaped wings (i.e., a lower part airflow guide plate, the finishing cone part, and the discharging cone part) that forms an open passage without a cap-shaped central blocking part. That is, such non-powered ventilators may have a structure being stacked and assembled of the finishing cone part having a cap-shaped rainwater inflow structure at the uppermost part (based on the vertical direction) and the discharging cone part having at least one or more of opened central parts under the finishing cone part (see Korean Patent No. 10-1604819).

Therefore, such a ventilator is implemented by blocking an inflow of rainwater from the outside with a cap-shaped circular plate blocking the outside air, or by modifying a retractable lid for the discharge of airflow (see Korean Patent Nos. 10-0976704 and 10-0436840).

As related art, there are provided:

1. Korean Patent No. 10-0976704 (registered on Aug. 11, 2010, title of invention: FIXED VENTILATING DEVICE)

2. Korean Patent No. 10-0436840 (registered on Jun. 10, 2004, title of invention: VENTILATOR FOR FIXING TYPE)

3. Korean Patent No. 10-1604819 (registered on Mar. 14, 2016, title of invention: VENTILATOR).

DISCLOSURE

Technical Problem

The objective of the present invention is to improve the stacked structure for smooth discharge of polluted indoor air from such conventionally known non-powered ventilators.

Another objective of the present invention is to prevent inflow of rainwater from the non-powered ventilator for smooth discharge of the polluted indoor gas.

Yet another objective of the present invention is to provide a non-powered ventilator capable of being stacked only with the same discharging cap part that has an opened central part and has no separate cap for blocking rainwater inflow at the uppermost part.

Still another objective of the present invention is to provide an improved non-powered ventilator for preventing the inflow of rainwater and increasing a discharge effect of the indoor airflow by preventing backdraft, even when only the opened discharging cap parts are stacked.

The main objective of the present invention is to provide a non-powered ventilator that blocks a backdraft flowing into a room by allowing most of the primary inflow airflow (i.e., a vertical inflow airflow) introduced by a side-pass airflow from the outside to have no normal flow and form vortices, and smoothly exhausts the indoor airflow by the secondary inflow airflow (i.e., a horizontal inflow airflow), when the indoor airflow is discharged from an exhaust duct to the outside by the side-pass airflow in a horizontally installed state.

Technical Solution

The non-powered ventilator of the present invention for achieving the above objectives is implemented by the non-powered ventilator including:

a fixing member provided with a vertical cylinder having opened front and rear ends thereof and provided with a fixing flange part horizontally extended at a right angle from an upper end of the vertical cylinder; a finishing cap part provided with a passage formed by a central part thereof, provided with a finishing cone part formed of a circular inclined side with a narrow upper end and a wide lower end to surround the passage, provided with an opening part at the narrow upper end of the finishing cone part, provided with a finishing flange part horizontally extended at a right angle from the wide lower end of the finishing cone part, and provided with fastening holes in the finishing flange part; a discharging cap part provided with a passage formed by a central part thereof, provided with a discharging cone part formed of a circular inclined side with a narrow upper end and a wide lower end to surround the passage, provided with an opening part at the narrow upper end of the discharging cone part, provided with a discharging flange part horizontally extended at a right angle to the wide lower end of the discharging cone part, and provided with fastening holes in the discharging flange part, so that the fixing flange part of the fixing member and the discharging flange part are assembled and installed correspondingly; a backdraft prevention member provided with a hemispherical curved plate body having a middle part thereof protruding in a circular shape, provided with support legs extending from a peripheral part of the curved plate body, the support legs being formed of fastening holes corresponding to the fastening holes of the stacked discharging cap part and the finishing cap part, provided with opening parts through which airflow is circulated and introduced at positions between the support legs, thereby being installed between the stacked finishing cap part and the discharging cap part; and fastening members fastened and assembled by bolts and nuts through the fastening holes of the discharging cap part, the backdraft prevention member, and the fixing member.

In the forming of the gap a between the lower side of the circular groove of the backdraft prevention member and the bent edge part of the discharging cap part of the non-powered ventilator of the present invention in order to achieve the objectives thereof, the forming of the gap a may be implemented by the non-powered ventilator enabling the gap a between the lower part of the backdraft prevention member and the upper side opening part of the discharging cap part to be adjustable.

The backdraft prevention member of the non-powered ventilator of the present invention for achieving the above objectives may be preferably implemented by the non-powered ventilator that forms a first bent edge part and the circular groove at the peripheral part of the curved plate body to prevent the inflow of rainwater and forms a second bent edge part at the peripheral part of the upper passage of the stacked discharging cap part to form a vortex formation area b in which the vortices are formed at the airflow inlet side between the first and second bent edge parts.

The discharging cap part of the non-powered ventilator of the present invention for achieving the above objectives may form a predetermined gap a between the lower side of the circular groove of the backdraft prevention member and the second bent edge part, so that the backdraft prevention member may allow the gap a to be adjustable by itself depending on the discharge air pressure of the indoor airflow and the outside airflow.

Advantageous Effects

As described above, in the present, invention, even when the finishing cap part to block inflow of rainwater installed on the uppermost layer is improved with the finishing cap part having the opened central part, the inflow of rainwater is blocked by the backdraft prevention member. Although the names are called the finishing cap part and the discharging cap part, the same effect is to be obtained even when the discharging cap part provided with the opened central part having substantially almost the same shape with each other are stacked, thereby increasing productivity by saving manufacturing cost.

The present invention has an effect of providing a non-powered ventilator, wherein, even when the uppermost layer (when installed vertically) does not have a cap-shaped finishing structure that blocks inflow of rainwater, it is possible to smoothly discharge polluted indoor gas (hereinafter referred to as indoor airflow) and block the inflow of rainwater.

In the present invention, when the indoor airflow is discharged from the exhaust duct to the outside in a horizontally installed state, the primary inflow air (i.e., the vertical inflow airflow) introduced by the side-pass airflow from the outside is mostly blocked, and the indoor airflow is smoothly exhausted by secondary airflow (i.e., an airflow forming an exhaust airflow, the horizontal inflow airflow), thereby obtaining an effect of providing the ventilator that improves exhaustion effects for gas such as indoor exhaust gas.

In particular, the present invention is capable of standardizing a size of each part and selecting each part appropriately as needed depending on an amount of exhaust gas or a size of an exhaust duct. In addition, the present invention prevents the exhaust gas from staying in the ventilator, prevents foreign matter from entering the exhaust duct, and may prevent the backdraft caused by strong outside wind. In addition, the present invention facilitates a connection between the ventilator and the exhaust duct or between each of parts, and may prevent safety accidents due to handling the ventilator. In addition, the present invention may provide a modular ventilator depending on the size of the exhaust duct, may be easy to install, may reduce unit cost through weight lighting, and may avoid damage to a sink by preventing an airflow passing through the ventilator due to strong winds caused by typhoons, etc.

DESCRIPTION OF DRAWINGS

FIG. 1 is a perspective view showing a vertical state of a non-powered ventilator of the present invention.

FIG. 2 is a cross-sectional view showing the vertical state of the non-powered ventilator of the present invention.

FIG. 3*a* is an exploded perspective view showing the vertical state of a first exemplary embodiment of the non-powered ventilator of the present invention.

FIG. 3*b* is an exploded perspective view showing a vertical state of a second exemplary embodiment of the non-powered ventilator of the present invention.

FIG. 4*a* is a perspective view showing a discharging cap part of the non-powered ventilator of the present invention.

FIG. 4*b* is a cross-sectional view showing the discharging cap part of the non-powered ventilator of the present invention.

FIG. 5*a* is a perspective view showing a backdraft prevention member of the non-powered ventilator of the present invention.

FIG. 5*b* is a cross-sectional view showing the backdraft prevention member of the non-powered ventilator of the present invention.

FIG. 6*a* is a perspective view showing a finishing cap part of the non-powered ventilator of the present invention.

FIG. 6*b* is a cross-sectional view showing the finishing cap part of the non-powered ventilator of the present invention.

FIG. 7 is a cross-sectional view showing an installation state for describing movement of indoor and outdoor airflow of the non-powered ventilator of the present invention.

FIG. 8 is a cross-sectional view showing an installation state for describing an action of the backdraft prevention member of the non-powered ventilator of the present invention.

MODE FOR INVENTION

Hereinafter, a preferred exemplary embodiment of the non-powered ventilator of the present invention will be described in detail with reference to the accompanying drawings.

Among the terms introduced in the present invention, terms such as a finishing cap part, a discharging cap part, a finishing cone part, and a discharging cone part are defined in the contents of the pre-registered Korean Patent No. 10-1604819, and therefore, the terms will be used as they were used in the cited document.

Among the accompanying drawings, FIG. 1 is a perspective view showing a vertical state of a non-powered ventilator of the present invention, FIG. 2 is a cross-sectional view showing the vertical state of the non-powered ventilator of the present invention, and FIG. 3*a* is an exploded perspective view showing a vertical state of a first exemplary embodiment of the non-powered ventilator of the present invention.

The non-powered ventilator of the present invention in accordance with the terms defined above and illustrated by the accompanying drawings includes: a finishing cap part 10, a discharging cap part 30, a backdraft prevention member 20, a fixing member 40, and a fastening member 50.

The finishing cap part 10 has a cap-shaped (i.e., a cap, a lid, or a ventilation lid installed outside an exhaust duct) outer cover structure, including: a passage 17 formed by a central part thereof having an opened shape; a finishing cone part 15 having a circular inclined side with a narrow upper end and a wide lower end to surround the passage 17; a finishing flange part 11 horizontally extended at a right angle at a position below the finishing cone part 15; and a fastening hole 13 formed in the finishing flange part 11.

The backdraft prevention member 20 includes: a curved plate body 21 having a middle part thereof protruding in a circular shape; support legs 22 extended in at least two directions (actually three directions) at the peripheral part of the curved plate body 21; fastening holes 23 provided by the support legs 22, the fastening holes 23 corresponding to fastening holes 33 of the stacked discharging cap parts 30; and opening parts 24 circulating and guiding airflow therethrough and provided at positions between the support legs 22, thereby being installed between the stacked finishing cap part 10 and the discharging cap part 30.

The discharging cap part 30 includes: a passage 37 formed by a central part thereof having an opened shape; a discharging cone part 35 formed of a circular inclined side with a narrow upper end and a wide lower end to surround the passage 37; a discharging flange part 31 horizontally extended at a right angle at the lower side of the discharging cone part 35; and a fastening hole 33 in the discharging flange part 31 as well, whereby the fixing flange part 21 of the fixing member 40 and the discharging flange part 31 are assembled and installed correspondingly.

The fixing member 40 includes: a vertical cylinder 41 having opened front and rear ends thereof; a fixing flange part 42 horizontally extended at a right angle at one end of the vertical cylinder 41; and fastening holes 43, thereby being installed in an exhaust duct of a building.

As shown in FIGS. 1, 2, and 3*a*, the fastening member 50 assembles the finishing cap part 10, the backdraft prevention member 20, the discharging cap part 30, and the fixing member 40 by fastening with bolts 51 and nuts 52, so as to fasten the parts and members through the fastening holes 13, 23, 33, and 43 of the finishing cap part 10, the backdraft prevention member 20, the discharging cap part 30, and the fixing member 40, respectively.

Among the accompanying drawings, FIG. 4*a* is a perspective view of the discharging cap part of the non-powered ventilator of the present invention, and FIG. 4*b* is a cross-sectional view of the discharging cap part of the non-powered ventilator of the present invention.

As shown in FIGS. 4*a* and 4*b* above, the finishing cap part 10 has a cap-shaped (i.e., a cap, a lid, or a ventilation lid installed outside an exhaust duct) outer cover structure, including: a passage 17 formed by a central part thereof; a finishing cone part 15 having a circular inclined side with a narrow upper end and a wide lower end to surround the passage 17; an opening part 17 provided at the upper end of the finishing cone part 15; a finishing flange part 11 horizontally extended at a right angle at a position below the finishing cone part 15; and a fastening hole 13 formed in the finishing flange part 11.

Among the accompanying drawings, FIG. 5*a* is a perspective view showing a backdraft prevention member of the non-powered ventilator of the present invention, and FIG. 5*b* is a cross-sectional view showing the backdraft prevention member of the non-powered ventilator of the present invention.

As shown in FIGS. 5*a* and 5*b* above, the backdraft prevention member 20 includes: a hemispherical curved plate body 21 having a middle part thereof protruding in a circular shape; support legs 22 extended in at least three directions at the peripheral part of the curved plate body 21; fastening holes 23 provided by the support legs 22, the fastening holes 23 corresponding to fastening holes 33 of the stacked discharging cap parts 30; and opening parts 24 circulating and guiding airflow therethrough and provided at positions between the support legs 22, thereby being installed between the stacked finishing cap part 10 and the discharging cap part 30. The backdraft prevention member 20 forms a first bent edge part 26 and a circular groove 25 in the peripheral part 22 of the curved plate body 21 to prevent an inflow of rainwater, and may form a vortex forming area b on an airflow inlet side between each finishing flange part 11 and discharging flange part 31 of the stacked finishing cap part 10 and discharging cap part 30.

A gap a is formed between the lower side of the circular groove 25 of the backdraft prevention member 20 and a second bent edge part 36 of the discharging cap part 30, so that the backdraft prevention member 20 may allow the gap to be movable depending on discharge air pressure of the indoor airflow and the outside airflow. The backdraft prevention member 20 movable depending on the discharge air pressure of the indoor airflow may affect the discharge of the indoor airflow in proportion to the intensity of the outside airflow.

The non-powered ventilator of the present invention implemented as described above may have a multi-layer assembly structure composed of the same finishing cap parts 10 of FIG. 3*a*. In this exemplary embodiment of the non-powered ventilator of the present invention, even when being stacked with finishing cap parts having an opened central part, the inflow of rainwater is to be blocked by the backdraft prevention member 20, so that the finishing cap part 10 and the discharging cap part 30 are stacked in the same shape, thereby saving manufacturing cost and increasing productivity. The present invention provides a non-powered ventilator in which a smooth discharge of indoor airflow is achieved and an inflow of rainwater may be blocked, even though the uppermost layer (when installed vertically) does not have a cap-shaped finishing structure that blocks rainwater from entering.

A non-powered ventilator according to a second exemplary embodiment of the present invention will be described.

Among the accompanying drawings, FIG. 3*b* is an exploded perspective view showing a vertical state of a second exemplary embodiment of the non-powered ventilator of the present invention, FIG. 6*a* is a perspective view showing a finishing cap part of the non-powered ventilator of the present invention, and FIG. 6*b* is a cross-sectional view of the finishing cap part of the non-powered ventilator of the present invention.

The finishing cap part 10, the backdraft prevention member 20, the fixing member 40, and the fastening member 50 described above follow the description of the above configuration.

That is, the finishing cap part 10 has a cap-shaped (i.e., a cap, a lid, or a ventilation lid installed outside an exhaust duct) outer cover structure, including: a passage 17 formed by a central part thereof having an opened shape; a finishing cone part 15 having a circular inclined side with a narrow upper end and a wide lower end to surround the passage 17; a finishing flange part 11 horizontally extended at a right angle at a position below the finishing cone part 15; and a fastening hole 13 formed in the finishing flange part 11.

The backdraft prevention member 20 includes: a hemispherical curved plate body 21 having a middle part thereof protruding in a circular shape; support legs 22 extended in at least two directions (actually three directions) at the peripheral part of the curved plate body 21; fastening holes 23 provided by the support legs 22, the fastening holes 23 corresponding to fastening holes 33 of the stacked discharging cap parts 30; and opening parts 24 circulating and guiding airflow therethrough and provided at positions between the support legs 22, thereby being installed between the stacked finishing cap part 10 and the discharging cap part 30.

The fixing member 40 includes: a vertical cylinder 41 having opened front and rear ends thereof; a fixing flange part 42 horizontally extended at a right angle at one end of the vertical cylinder 41; and fastening holes 43, thereby being installed in an exhaust duct of a building.

As shown in the drawings, the fastening member 50 assembles the finishing cap part 10, the backdraft prevention member 20, the discharging cap part 30, and the fixing member 40 by fastening with bolts 51 and nuts 52, so as to fasten the parts and members through the fastening holes 13, 23, 33, and 43 of the finishing cap part 10, the backdraft prevention member 20, the discharging cap part 30, and the fixing member 40, respectively.

The non-powered ventilator of the present invention according to the drawings may have the multi-layer assembly structure of the finishing cap part 10 and the discharging cap part 30, but the discharging cap part 30 has a difference from the finishing cap part 10. As shown in FIGS. 6*a* and 6*b* above, the discharging cap part 30 includes: a passage 37 formed by the central part thereof; a discharging cone part 35 formed of a circular inclined side with a narrow upper end and a wide lower end to surround the passage 37; a second bent edge part 36 provided at an upper end of the discharging cone part 35; a discharging flange part 31 horizontally extended at a right angle at the lower side of the discharging cone part 35; and a fastening hole 33 in the discharging flange part 31 as well, whereby the fixing flange part 21 and the discharging flange part 31 of the fixing member 40 are assembled and installed correspondingly. The non-powered ventilator implemented as described above may have a multi-layer assembly structure of the finishing cap part 10 and the discharging cap part 30 as shown in FIG. 3*b*, and may be implemented by using the discharging cap part 30 having a modified structure of the finishing cap part 10.

Among the accompanying drawings, FIG. 7 is a cross-sectional view showing an installation state describing indoor and outdoor airflow movement of the non-powered ventilator of the present invention.

As shown in FIG. 7, the gap a is formed between the lower side of the circular groove 25 of the backdraft prevention member 20 and the second bent edge part 36 of the discharging cap part 30, and the backdraft prevention member 20 may form the first bent edge part 26 and the circular groove 25 in the peripheral part 22 of the curved plate body 21 to prevent the inflow of rainwater.

In particular, it is preferable that the second bent edge part 36 is provided with a curved surface thereof having a size sufficient to change the direction of the inflow airflow.

In the process of discharge toward the outer inflow gas of the vortex forming area b, although there exist differences depending on air pressure of an indoor airflow primarily discharged from the inside, an airflow secondarily flowing into the gap a from the upper part (in horizontal installation), and an airflow tertiarily flowing into the curved plate body 21, a movement of the indoor airflow according to Bernoulli's principle in common is discharged to the lower side of the ventilator in the horizontal installation state, but in particular, the vortex forming area (i.e., the circular arrows) by the second bent edge part 36 may be formed, so that the discharge airflow may be further accelerated without interfering with the airflow. A gas blocking wall has an exhaust effect that may be increased depending on the extent to which a gap a in the horizontal installation state forming the gap a may be reduced.

Preferably, the forming of the gas blocking wall is to be implemented without the gap a, but in the case where the gap a of the lower part is sufficiently widened in the horizontal installation state, the downward flow of the indoor airflow, which is ideally preferable, may be induced. That is, the vortex forming area b may be formed on the inlet side between each finishing flange part 11 and the discharging flange part 31 of the stacked finishing cap part 10 and discharging cap part 30, and the inflow of airflow that interferes with the discharge of indoor airflow at the upper part is to be blocked, so that the indoor air such as exhaust gas discharged along the central part passage of the installed ventilator is discharged downward (in the horizontal installation state), whereby the indoor airflow may be accelerated, suctioned, and discharged by the airflow that has passed through the curved plate body 21.

The normal discharge of the airflow is proportional to the flow rate of the downward airflow toward the curved plate body 21, so that the indoor airflow is exhausted, but additionally, appropriate suppression of the inflow of airflow through the gap a may allow the discharge of the airflow to be accelerated.

Therefore, in the horizontal installation state (in FIG. 7), since the airflow flowing from the outside in the vertical direction has an airflow movement toward the gap a, having an extent that is slightly insignificant, most of the gas discharged from a room will move downward along the inner side surface of the curved plate body 21 of the backdraft prevention member 20. The flow of the downward movement is mostly moved by the negative pressure generated as the airflow flowing from the outside of the curved plate body 21 moves downward. The gap a may be fully calculated according to wind power of an installation site and an installation position thereof when designing the ventilator. However, as will be described later, the gap a shown in FIG. 8 may be designed to be movable in proportion to the natural air pressure of the outside airflow or the indoor airflow.

Among the accompanying drawings, FIG. 8 is a cross-sectional view showing an installation state for describing an action of the backdraft prevention member of the non-powered ventilator of the present invention.

Describing the operation of the non-powered ventilator of the present invention as shown in FIG. 8 is as follows.

As shown in the drawings and FIG. 7, the gap a is formed between the lower side of the circular groove 25 of the backdraft prevention member 20 and the second bent edge part of the discharging cap part 30, and the backdraft prevention member 20 may allow the gap a to be movable depending on the discharge pressure of the indoor airflow and the outside airflow. The backdraft prevention member 20 movable depending on the discharge air pressure of the indoor airflow may affect the discharge of the indoor airflow in proportion to the intensity of the outside airflow.

The circular groove 25 described above in the vertical installation state may prevent rainwater from entering a room. In addition, values of the width of the support leg 22 of the backdraft prevention member 20 and the opening space 24 between the support legs 22, the opening space becoming an airflow path after installation, are also adjusted depending on an installation site and an installation position thereof, and will be reflected in the design.

The present invention has been described with reference to the exemplary embodiments shown in the drawings, but these are exemplary, and those skilled in the art will appreciate that various modifications and other equivalent embodiments are possible. The technical protective scope of the present invention will be defined by the claims.

DESCRIPTION OF THE MAIN NUMERALS IN THE DRAWINGS

10: finishing cap part
11: finishing flange part
13: fastening hole
15: finishing cone part
17: passage
20: backdraft prevention member
21: curved plate body
22: support leg
23: fastening hole
24: opening part
25: circular groove
26: first bent edge part
30: discharging cap part
31: discharging flange part
33: fastening hole
34: discharge bent part
35: discharging cone part
36: second bent edge part
37: passage
40: fixing member
41: vertical cylinder
42: fixing flange part
50: fastening member
51: fastening bolt
52: fastening nut

The invention claimed is:

1. A non-powered ventilator comprising:

a fixing member provided with a vertical cylinder having opened front and rear ends thereof and provided with a fixing flange part horizontally extended at a right angle from an upper end of the vertical cylinder;

a finishing cap part provided with a passage formed by a central part thereof, provided with a finishing cone part formed of a circular inclined side with a narrow upper end and a wide lower end to surround the passage, provided with an opening part at the narrow upper end of the finishing cone part, provided with a finishing flange part horizontally extended at a right angle from the wide lower end of the finishing cone part, and provided with fastening holes in the finishing flange part;

a discharging cap part provided with a passage formed by a central part thereof, provided with a discharging cone part formed of a circular inclined side with a narrow upper end and a wide lower end to surround the passage, provided with an opening part at the narrow upper end of the discharging cone part, provided with a discharging flange part horizontally extended at a right angle to the wide lower end of the discharging cone part, and provided with fastening holes in the discharging flange part, so that the fixing flange part of the fixing member and the discharging flange part are assembled and installed correspondingly;

a backdraft prevention member provided with a hemispherical curved plate body having a middle part thereof protruding in a circular shape, provided with at least three support legs extending from a peripheral part of the curved plate body, the support legs being fastened by forming fastening holes corresponding to the fastening holes of the stacked finishing cap part and discharging cap part, provided with opening parts through which airflow is introduced at positions between the support legs, and simultaneously provided with a first bent edge part and a circular groove along the circular peripheral part of the curved plate body, thereby being installed between the stacked finishing cap part and the discharging cap part; and fastening members fastened and assembled by bolts and nuts through the fastening holes of the discharging cap part, the backdraft prevention member, and the fixing member, so as to form a gap a between the backdraft prevention member and the discharging cap part.

2. The non-powered ventilator of claim 1, wherein the backdraft prevention member is provided with the circular groove and the first bent edge part along the peripheral part of the curved plate body, and the discharging cap part is provided with a second bent edge part, so that a part of inflow airflow forms vortices in a peripheral part of an upper end passage, whereby a blocking area b is formed to block airflow movement by collision of the airflows at an outside airflow inlet side between the finishing flange part of the finishing cap part and the discharging flange part of the discharging cap part.

3. The non-powered ventilator of claim 1, wherein, in forming the gap a between a lower side of the first bent edge part of the backdraft prevention member and the second bent edge part of the discharging cap part, the gap a between a lower part of the backdraft prevention member and the upper side passage of the discharging cap part is adjustable.

* * * * *